US007448858B2

(12) United States Patent
Neumair et al.

(10) Patent No.: US 7,448,858 B2
(45) Date of Patent: Nov. 11, 2008

(54) PUMP AGGREGATE

(75) Inventors: Georg Neumair, Thalhausen (DE); Gerhard Lörner, Eching (DE)

(73) Assignee: Hawe Hydraulik GmbH & Co. KG, Munich (DE)

( * ) Notice: Subject to any disclaimer, the term of this patent is extended or adjusted under 35 U.S.C. 154(b) by 405 days.

(21) Appl. No.: 11/336,351

(22) Filed: Jan. 20, 2006

(65) Prior Publication Data

US 2006/0228235 A1 Oct. 12, 2006

(30) Foreign Application Priority Data

Apr. 8, 2005 (DE) ..... 20 2005 005 620 U

(51) Int. Cl.
*F04B 17/00* (2006.01)
*F04B 35/04* (2006.01)

(52) U.S. Cl. ..... 417/410.1; 417/410.3; 417/271; 417/372; 417/273; 29/888; 29/888.02

(58) Field of Classification Search ..... 417/410.1, 417/410.3, 410.4, 415, 199.1, 271, 372, 273; 29/888, 888.02
See application file for complete search history.

(56) References Cited

U.S. PATENT DOCUMENTS 4,573,324 A * 3/1986 Tischer et al. ..... 62/115
5,399,075 A * 3/1995 Frank et al. ..... 417/423.1
6,132,184 A * 10/2000 Robertson et al. ..... 417/410.3
6,257,364 B1 * 7/2001 Parkhill et al. ..... 180/417
6,488,480 B1 * 12/2002 Zhong ..... 417/310
6,524,084 B2 * 2/2003 Neumair ..... 417/372
6,551,071 B1 * 4/2003 Blender et al. ..... 417/68
6,589,029 B1 * 7/2003 Heller ..... 417/415
6,700,273 B1 * 3/2004 Ojima et al. ..... 310/166
2001/0028850 A1 * 10/2001 Neumair ..... 417/199.1
2003/0108446 A1 * 6/2003 Hida et al. ..... 418/201.1
2004/0170512 A1 * 9/2004 Yannascoli et al. ..... 417/410.4
2004/0219035 A1 * 11/2004 Hundt et al. ..... 417/368

FOREIGN PATENT DOCUMENTS

DE 38 39 689 A1 5/1990
EP 0 940 578 A1 5/1998

OTHER PUBLICATIONS

Standard Search Report and Annex dated Sep. 20, 2005.

* cited by examiner

*Primary Examiner*—Devon Kramer
*Assistant Examiner*—Amene S Bayou

(57) ABSTRACT

A pump aggregate A comprises a one-piece cast hollow body 1 including an exterior connection block 3 and an interior lateral wall 16 of a bearing shield. A pressure transmission path is formed by a channel K which is made by casting in the lateral wall 16 of the bearing shield and which extends from the connection block 3 into a pump element mounting surface 18, 18', 18" of the lateral wall 16 of the bearing shield.

19 Claims, 5 Drawing Sheets

PUMP AGGREGATE

Figure 1:
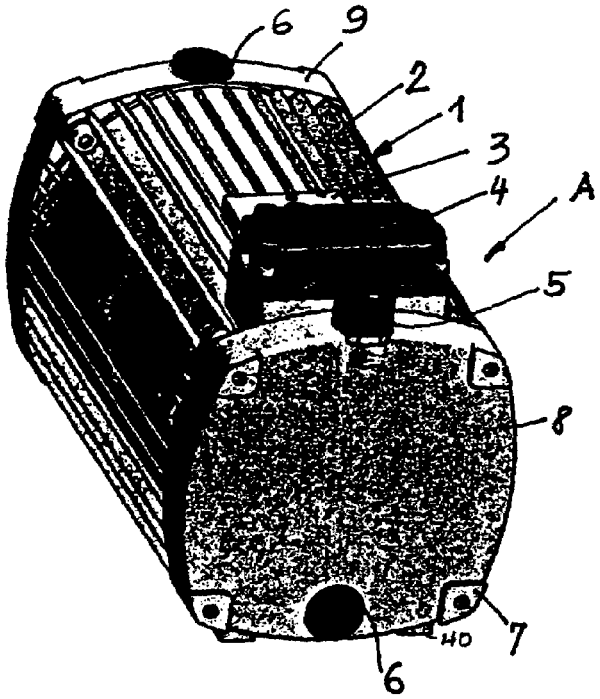

The invention relates to a pump aggregate of the kind as hereinafter described and depicted.

The pump aggregate known in practice and from the leaflet D 7900 "Compact Pump Aggregate Type HC" of the company HAWE Hydraulics, Heilmeier & Weinlein, Streitfeldstraβe 25, 81 Munich (Edition February 2001-01) has a substantially block shaped hollow cast body which is closed at round sealing surfaces by round, flat or deep drawn cover lids. The connection block is screwed to a side wall and communicates with the respective pump element or the pump element group via at least one pressure line which is installed inside. The stator is fixed by shrinkage in the holding collar for the stator. At least one pump element is mounted to the lateral wall of the bearing shield. The pump element is driven by the wet-pit electric motor. The power cable introduction towards the wet-pit electric motor is installed in one of the cover lids. A base type of the cast hollow body allows only a restricted number of different combinations of a wet-pit electric motor and of pump elements. Furthermore, the structure consists of many parts and is complicated in terms of assembly, mainly because different combinations have to be customized for the respective application. Due, among others, to the shape of the cast hollow body and of the round sealing seats for the cover lids, the cast hollow body has to have interior undercuts which need to provide casting moulds having interior radially moveable cores. The production of the cast hollow body is expensive since inserting and fixing interior cores means high costs and complicated labor.

Further pump aggregates are known from DE 24 13 691 A, DE 35 13 472 A and EP 0 676 851 A.

Pump aggregates of this kind in recent time have been used in increasing numbers in practice. Depending on the application requirements significantly differing hydraulic outputs are needed, which until now, only could be achieved by assembling individually customized and differing pump aggregates. A broad variation of types each in a small lot size, however, causes high manufacturing costs and assembly costs. For it exists a significant demand for that reason to have a motor pump aggregate of large variability and more hydraulic output for less money by using as many equal parts as possible.

It is an object of the invention to provide a pump aggregate of the kind as mentioned at the beginning which is adapted to cover a broad variety of differing installation sizes with as many equal parts as possible and which for this reason is less costly than the conventional ones. A part of the object is to provide a concept of a light metal hollow cast body for different types of pump aggregates into which concept a large number of functions, even selectively useable functions is incorporated already from the outset.

This object is achieved by the features of the invention herein described and depicted.

The integration of the channel already by casting into the lateral wall of the bearing shield defining the mounting surface for different kinds of pump elements can be realized for fair costs because then the casting mould does not need interior, radially moveable core parts. Furthermore, the integration facilitates the later installation of any type of pump element because the connection of the pump element with the connection block automatically will be established when mounting the pump element at the mounting surface. Furthermore, no separate pipings have to be produced and installed. The hollow body can be formed as a light metal chill casting having relatively high pressure resistance already by nature such that the channel formed by casting can be used for low pressure applications and medium pressure applications without having a pressure proof lining, e.g. in co-action with at least one gear-type pump element. The channel also can be used for connecting e.g. radial piston pump elements even for higher pressure ranges. Since the pressure resistance of chill casting in some cases might not be sufficient for higher pressure ranges, a pressure proof lining may be installed in the channel. Machining after treatments of the cast hollow body are carried out in correspondence with the respective application editions. A large variety of different types and capacities of such pump aggregates can be covered with one and the same cast hollow body which means savings for the production in connection with the simplification when mounting the respective pump element type, and which minimizes the assembly procedures.

In order to use a relatively pressure resistant chill casting, particularly an aluminium chill casting, for the cast hollow body it might be expedient if the inner side extends at both ends of the cast hollow body to the round sealing surfaces without any inner cast undercuts. For this reason, radially moveable core parts can be dispensed with in the interior of the cast hollow body such that the costs for the casting process can be reduced.

In one embodiment having a rotor shaft which is supported in the interior of the pump aggregate, however, not in a cover lid, a bearing shield is secured on the stator which bearing shield may be identical in construction for stators of wet-pit electric motors having different lengths. By the use of such bearing shields which are identical in construction, further costs can be saved. The respective bearing shield only needs to be mounted with holding screws of different lengths.

Expediently, the channel has first and second sections. The first section is about perpendicular to the longitudinal axis, while the second section is substantially parallel to the longitudinal axis. These sections can be cast easily.

In case that in a certain embodiment a gear wheel pump element is mounted on the mounting surface of the lateral wall of the bearing shield, the channel either as it has been formed by the casting process or with minor after treatment can be used to directly connect the pump element to the connection block. To use the cast channel directly for the pressurized oil, basically is not conventional in case of light metal cast parts. This measure, however, saves the prefabrication and installation of pipings because e.g. aluminium chill cast is sufficiently pressure resistant to withstand the pressures in the low-pressure range or the medium-pressure range of gear wheel type pump elements without problems.

In contrast, if in another embodiment having at least one radial piston pump element, a higher pressure range has to be reckoned with, it might be expedient to mount the radial piston pump element with a steel connection block in a bore of the lateral wall of the bearing shield which bore intersects the first section of the channel. The bore can be made for low costs. The steel connection block and the steel lining inserted into the first section of the channel suffice to fulfil the pressure requirements and protect the casting material in the channel against the high pressure. Any machining treatments of the cast hollow body needed in this embodiment can be carried out with simple toolings and in simple labour steps for fair costs as the basic dimensional prerequisites are already provided by the casting process.

In order to avoid undesirable strong pulsations when providing a single radial piston pump element only, expediently several radial piston pump elements are mounted at the mounting surface, which piston pump elements are offset to each other in circumferential direction, and which are mounted in combination with steel connection blocks which assure the necessary pressure resistance. Pressure pipings installed, in some cases soldered, between the steel connection blocks form a pressure collecting system which is to be connected with the connection block via the lined channel. The pressure collecting system may be a substructure group which can be prefabricated for fair costs, in some cases already combined with the radial piston pump elements.

It may be expedient for the casting process when the wall of the cast hollow body is cylindrical. In this case, a small loss of oil volume has to be tolerated in comparison to a block shaped cast hollow body. However, this is a negligible drawback in view of the simplifications of the manufacturing achieved by this shape.

In view of high rigidity and desirable strong heat radiation to the exterior, the outer circumference of the cast hollow body is defined substantially by four arched sections, the radius of curvature of which substantially corresponds to the inner diameter of the cylindrical wall of the cast hollow body. Longitudinal ribs are already provided by the casting process between the cylindrical wall of the cast hollow body and the outer circumference.

In an expedient embodiment, the longitudinal ribs may define four groups, seen in a cross section of the cast hollow body such that the ribs in each group are parallel to each other, however, are offset from one group to another by about 90°.

The loss of the volume for the oil, caused by the cylindrical shape of the cast hollow body can be easily compensated for by using caps as the cover lids, which caps are secured to the round sealing surfaces. Each cap may be a cast body e.g. made from aluminium chill cast and may be shaped such that it does not have any inner undercut portions. For this reason the caps can also be produced for fair costs. The outer circumference of the caps corresponds to the outer circumference of the cast hollow body. In this case it is possible to combine caps having different heights with a basic type of the cast hollow body in order to achieve different oil volumes. The cap shape and design of the caps, which are very simple in terms of the casting process for forming them, further allows to provide an oil inlet opening and/or an oil outlet opening adjacent to the edge of the cap in the front side of the cap and in the sidewall of the cap, which openings, preferably, are offset to each other about the longitudinal axis by about 180°. Depending on the aggregate application position, i.e. in lying position or in up-right standing position, the respective most advantageous opening can be used for filling in oil and/or for draining oil. By equipping each cap with the openings already from the outset selectively useable optimum filling facilities and the draining facilities are provided, i.e. for the application cases: lying, standing or overhead position. These useful facilities can be provided without the need of time consuming and costly labour steps during the manufacturing of the respective mounting form of the pump aggregate.

The wide degree of freedom of chill cast technology with respect to shaping allows to already integrate the connection block into the wall of the cast hollow body, expediently into a thickened wall region and such that, expediently, no inner undercuts are formed which would need a costly casting process with inner-side moveable cores. In some case, the connection block even can be prepared by casting such that it will suffice all upcoming requirements for different concepts of the pump aggregate, e.g. for a single circuit system or for a dual circuit system, for connecting the return line or the like.

Furthermore, a mount for a junction box or for a terminal strip can be provided by casting in the thickened region adjacent to the connection block, expediently including at least one duct for later mounting a power line introduction element. The arrangement of the power line introducing element in the wall of the cast hollow body results in the advantage of a simpler design of the cover lids or caps which close the ends of the cast hollow body. Moreover, the caps for both ends of the cast hollow body may be of identical construction (principle of equal parts).

The same base type of the cast hollow body is used in several pump aggregate types having different lengths. In the case the oil volume given by the size of the cast hollow body does not suffice, caps of different lengths can be mounted or even a prolongation ring out of a set of prolongation rings of different lengths may be installed between a respective cap and the cast hollow body. Also in this case the principle of identical parts is widely considered for creating different types of pump aggregates.

In this case, each prolongation ring should expediently also be a cast body without any inner undercut portions and should have about the cross section of the end of the cast hollow body such that it suits both the cast hollow body and the respective cap. Thanks to the inner side being cast without undercuts, the prolongation ring can be produced for fair cost from hard aluminium chill cast.

In an expedient embodiment, a return port may be provided at the same time by casting in the connection block such that after treatments for connecting or installing the return system remain minimal. In the case of a dual circuit system, a further channel may be drilled either into the lateral wall of the bearing shield or through the wall only for connecting at least one further pump element. In this case, an installed steel lining in a further channel could be expedient in order to assure sufficient pressure resistance.

Although the ribs of the cast hollow body already result in a very effective cooling of the oil contained in the pump aggregate, which cooling capacity, in some cases, even allows a permanent operation, additionally a fan wheel may be provided on at least one cap of the pump aggregate which fan wheel cools the cooling ribs with air in order to achieve ideal prerequisites for a permanent operation of the pump aggregate. The fan wheel may either be driven by the rotor shaft, which is extended through the cap to the exterior, or by a separate driving motor which in some cases, may even be arranged externally.

Aluminium chill cast, at least in the cast hollow body, expediently also in the caps and the prolongation rings, allows to achieve high pressure resistance and provided that interior undercuts are avoided, fair manufacturing costs due to the elimination of interior radially movable cores. Outer cores which are moveable in radial and/or axial direction, namely do not significantly increase the costs when applying the chill casting technique in comparison with additional technical efforts of inner radially moveable cores.

Figure 2:
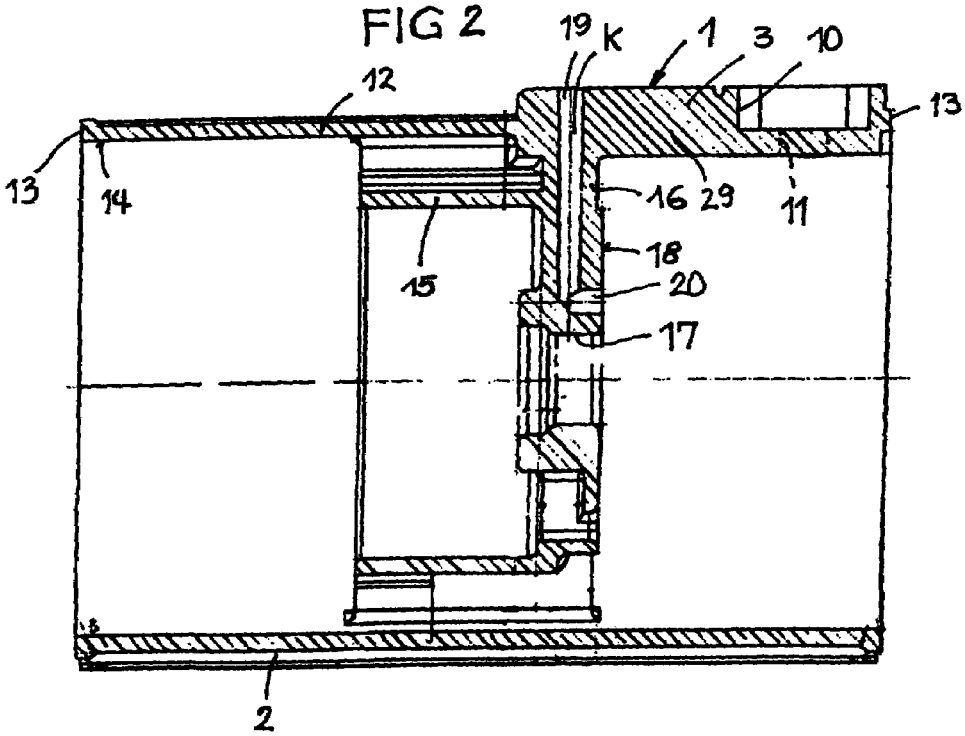
Figure 3:
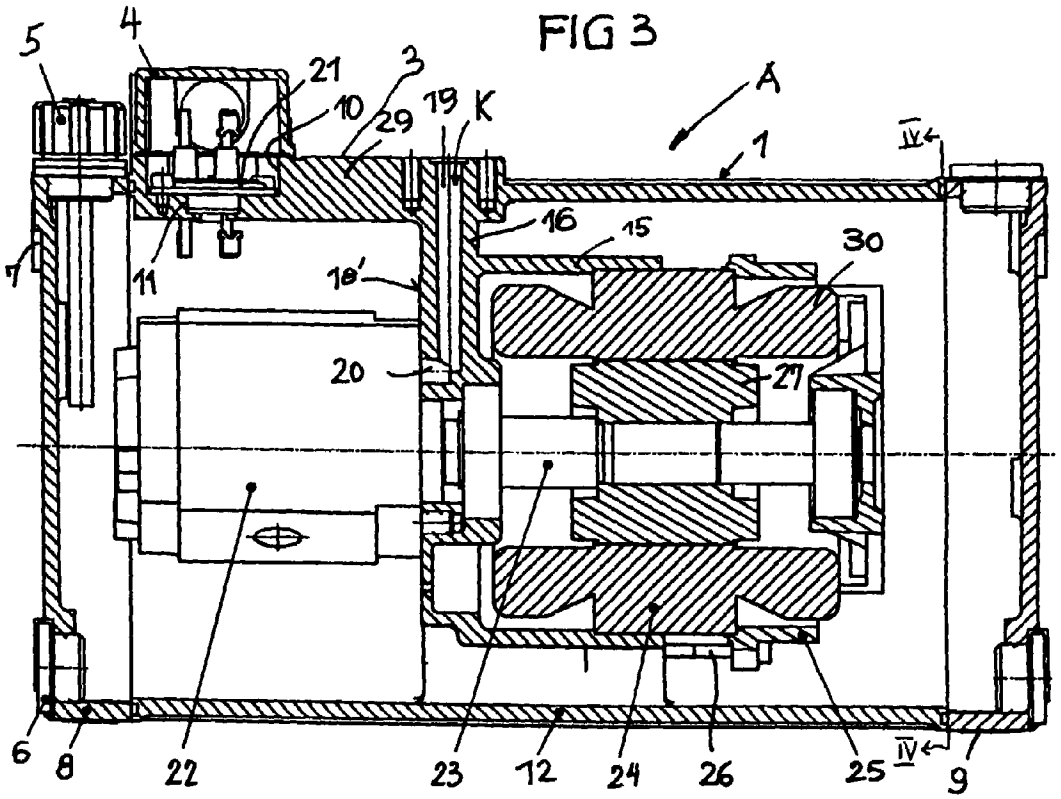
Figure 4:
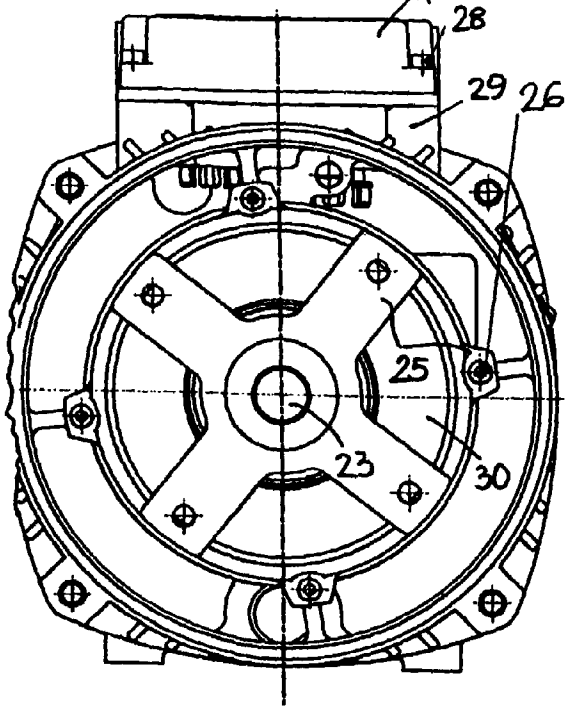
Figure 6:
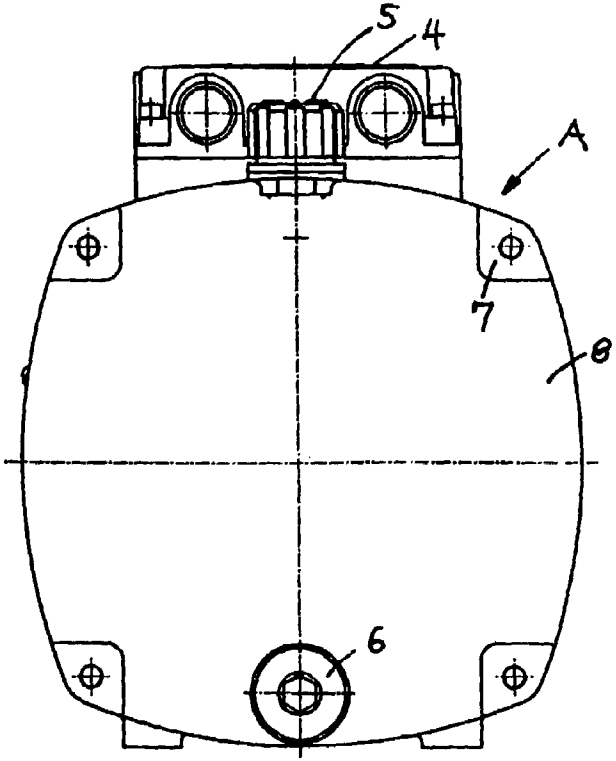
Figure 5:
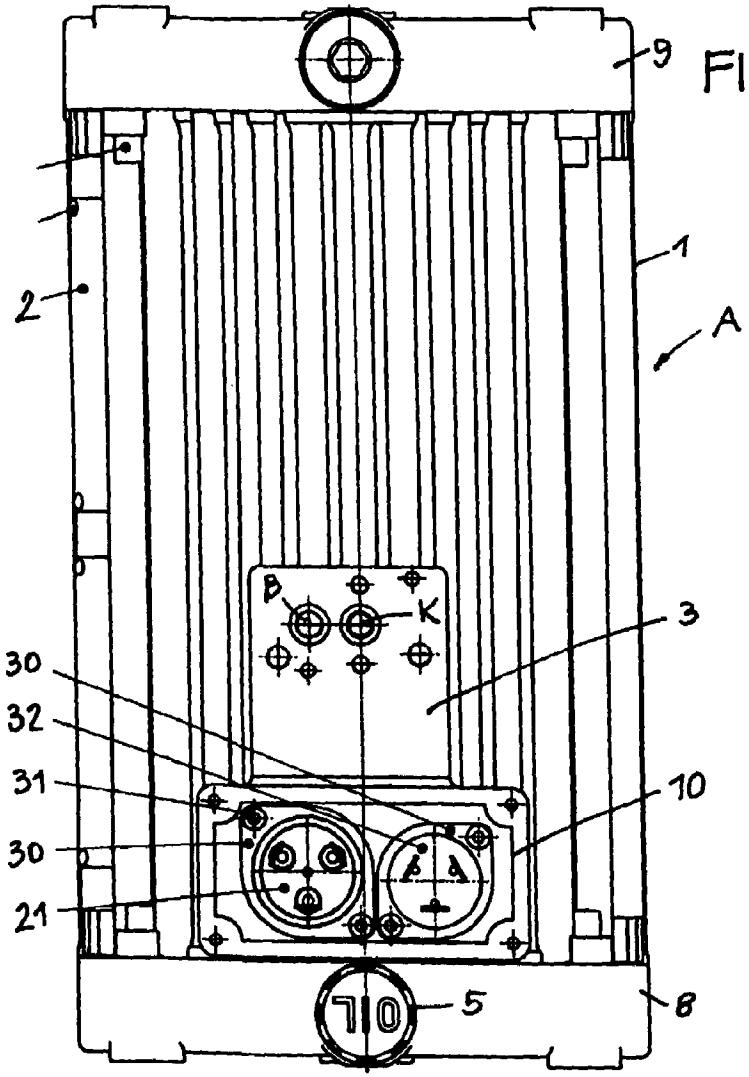
Figure 8:
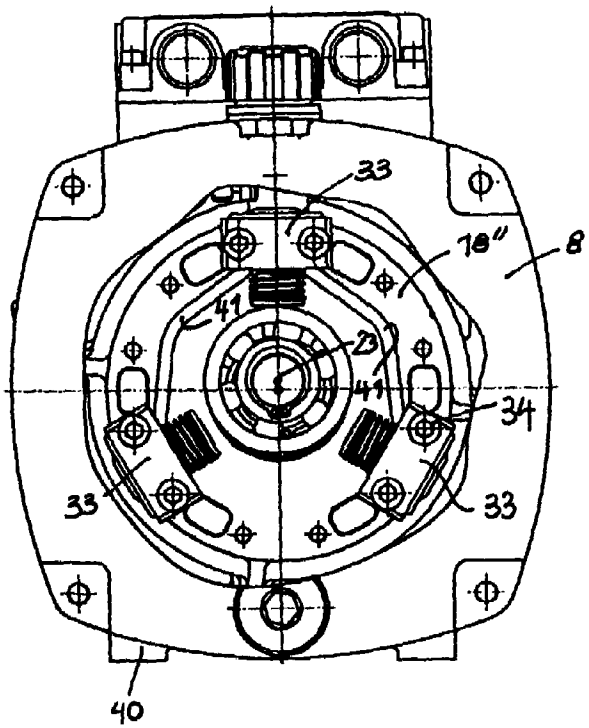
Figure 7:
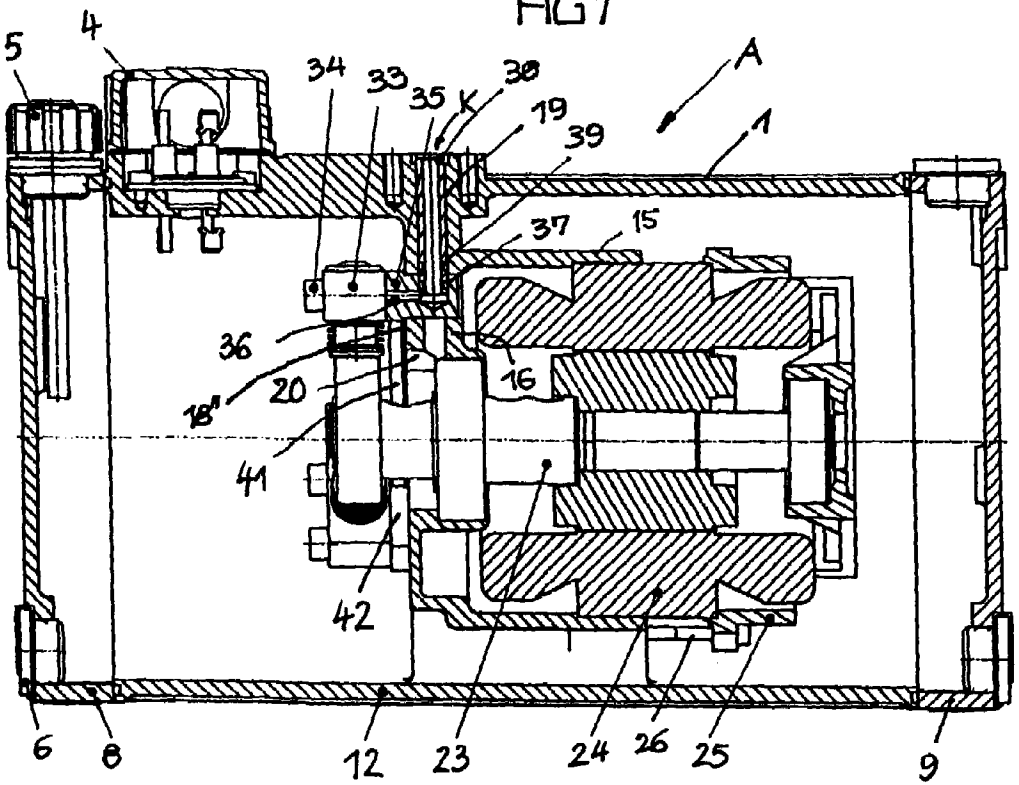
Figure 9:
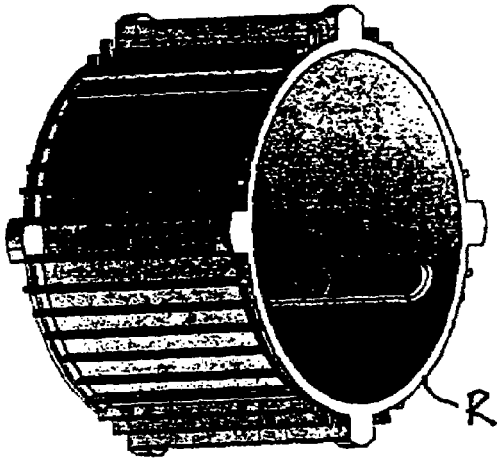
Figure 10:
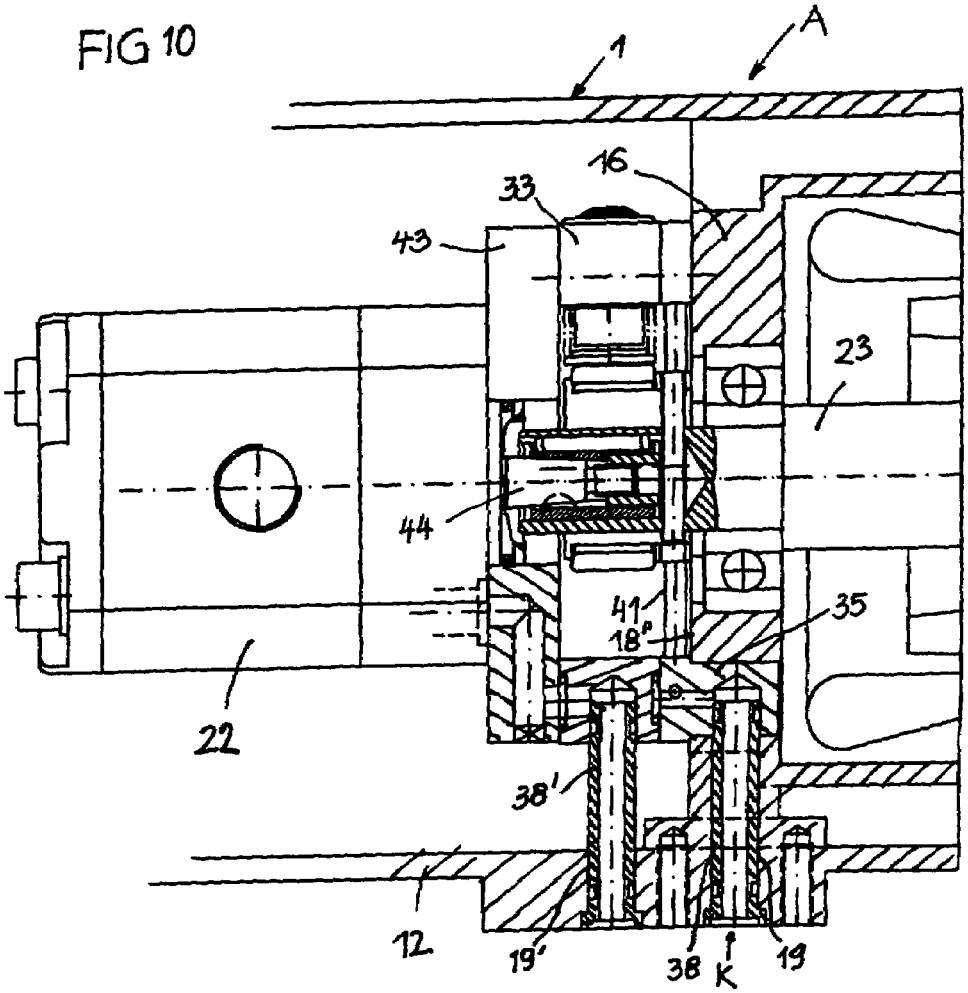

Embodiments of the invention will be explained with the help of the drawings. In the drawings is:

FIG. 1 a perspective view of a pump aggregate,

FIG. 2 a longitudinal section of a cast hollow body (raw parts prior to a machining treatment), FIG. 3 a longitudinal section of the pump aggregate of FIG. 1, FIG. 4 a section in FIG. 3 in the plane IV-IV, FIG. 5 a top view of the pump aggregate of FIG. 3 (with the junction box removed), FIG. 6 a view of the pump aggregate of FIG. 3 from the left side, FIG. 7 a longitudinal section of another embodiment of the pump aggregate of FIG. 1, FIG. 8 an illustration belonging to FIG. 7 with a viewing direction into the interior through a cut out in a cap which is the left cap in FIG. 7, FIG. 9 a perspective view of a prolongation ring, and FIG. 10 a detailed sectional view of another embodiment of the pump aggregate.

A pump aggregate A shown in FIG. 1 is a so-called motor pump aggregate for hydraulic applications and for providing a certain hydraulic capacity when permanently operated or when operating intermittently. The outer shape of the pump aggregate A is defined by a cast hollow body 1 e.g. having substantially rectangular outer contours and longitudinal ribs 2, a hydraulic connection block 3 integrated into the cast hollow body 1, a junction box 4 mounted on the cast hollow body 2, an oil filling-in opening 5, at least one oil draining opening 6, and cover lids having the shape of caps 8, 9 at both ends of the cast hollow body 1 which caps 8,9 are mounted in sealed fashion. Front side feet 7 e.g. are formed in regions of the caps 8, 9 in which tensioning screws engage which are inserted into the cast hollow body. 1. Further feet 40 may be formed at the lower side of the cast hollow body 1 and/or at the caps 8, 9 in FIG. 1. Expediently, the cast hollow body 1 is a aluminium chill cast part as, in some cases, also the caps 8, 9. Instead, other light metals or light metal alloys may be used as well.

FIG. 2 illustrates in a longitudinal section the body of the cast hollow body 1 which is used as a base type for different types of pump aggregates A. The connection block 3 is formed by casting into a thickened wall region 29 of a wall 12 of the cast hollow body 1 adjacent to mount 10. The ends of the cast hollow body 1 define circular sealing surfaces 13 for the respective cover lid or the cap 8, 9. These sealing surfaces have to be machined. At least one passing opening 11 may be cast into the mount 10, e.g. for a power cable introducing part which is to be inserted there. The cylindrical inner side of the cast hollow body 1 extends without undercuts to the end side sealing surfaces 13, i.e. without any undercuts such that the cast hollow body 1 can be produced in a casting mould which does not need inner radially moveable cores. A lateral wall 16 of a bearing shield is formed by casting integrally with the wall 12 and has central passage 15. A holding collar 15 for a stator is integrally formed with the lateral wall 16 of the bearing shield, which is connected by connecting ribs with the wall 12. Oil passages are kept free between the connecting ribs for communication between both sides of the lateral wall of the bearing shield. Beginning in the connection block 3 a channel K is formed in the wall 12 by casting. The channel consists of a first section 19 extending about perpendicular to the longitudinal axis of the cast hollow body 1 and a second section 20 communicating with the first section 19, the second section 20 extending about parallel to the longitudinal axis. The second section 20 opens into a mounting surface 18 at the lateral wall 16 of the bearing shield. The mounting surface 18 is provided in the body such that it can be finished by a later machining after treatment.

FIGS. 3-6 show sections and views of the first embodiment of the pump aggregate A of FIG. 1 which is assembled by using the cast hollow body 1 which, however, has been machined beforehand.

The ends of the cast hollow body 1 are closed by the caps 8, 9. Each cap has a front side and a skirt-like outer side. In the front side and the outer side openings 5, 6 are provided which are offset to each other by about 180°. Circular grooves for sealing elements are machined into the sealing surfaces 13. The junction box 4 is mounted on top of the mount 10. In the mount 10 a power cable introducing element is inserted in sealed fashion such that the power cable introducing element 21 extends through the opening 11 into the interior. The mounting surface 18 is treated by machining in FIG. 3 (mounting surface 18') in order to allow to mount a gear-wheel type pump element 22, which is driven by a rotor shaft 23 via by a coupling which is not shown in detail. The rotor shaft 23 carries a rotor 27 received within a stator 24 which in turn is secured in the holding collar 15 for the stator. The holding collar 15, in some cases may be machined at the inner side. The stator 24 may be secured by shrinkage and/or as shown by means of a bearing shield 25 supporting the other end of the rotor shaft 23 and which is tensioned by tensioning screws 26 against the holding collar 15 for the stator.

In order to provide different capacity stages of the electric motor, stators and rotors and rotor shafts having different lengths may selectively be used, expediently always with the same second bearing shield 25 being of identical construction. Only the tensioning screws 26 then have to have different lengths for these cases. The stator windings are indicated with reference number 30. The gear-wheel type pump element 22 is directly connected with the outer side of the connection block 3 via the channel K, i.e. via the first and second sections 19, 20. The pressure resistance of aluminium chill cast suffices to handle lower pressures or medium pressures without additional protection which pressure ranges are conventional for a gear wheel-type pump element.

FIG. 4 shows the bearing shield 25 (the cap 9 is removed) and the tensioning screws 26 and the end of the rotor shaft 23. The longitudinal ribs 2 define the outer contour of the cast hollow body 1 which can be seen in a cross section in FIG. 4. The outer contour is defined by four substantially equal arched sections each having a radius of curvature about corresponding to the inner diameter of the wall 12. The longitudinal ribs 4 are distributed in four groups and are parallel within each group while they are offset by about 90° from one group to the next.

FIG. 5 is a top view on the connection block 3 showing the mouth of the channel K and, in some cases, also the mouth of a return port B which also can be formed by casting. The power cable introducing element 91 is secured in sealed fashion in the mount 10 by means of a holding flange 30 and by fixation screws 31. In this embodiment a further electric member 32 e.g. a thermostat switch or the like, may be secured by a flange 30 in the mount 10. The longitudinal ribs 2 are not present in the caps 8, 9.

FIG. 6 is a view in FIG. 5 from the lower side and shows the substantially smooth front side of the cap 8 with the feet 7, the drain opening 6 and the fill-in opening 5 equipped with a closing cap located adjacently to the junction box 4.

The embodiment of the pump aggregate in FIGS. 7 and 8 differs from the pump aggregate of FIG. 3 in that several circumferentially distributed radial piston pump elements 30 are mounted on the, in some cases, differently machined mounting surface 18" and which (single circuit system) are connected via the channel K with the connection block. In some cases, the pressure resistance of aluminium chill cast may not be sufficient in the cast hollow body 1 for the high pressures provided by the radial piston pump elements 33. For this reason, the channel K already formed by the casting process is used for connecting the pump elements 33, however, is lined in such a way that the high pressure is kept away from the cast material.

In particular, a radial piston pump element 30 is mounted by fixation screws 34 on the mounting surface 18" by using a steel connection block 35 which is fitted into a bore drilled into the lateral wall 16 of the bearing shield. The bore intersects the first section 19 of the channel K. A connection bore 36 which extends substantially parallel to the longitudinal axis and a receiving bore 37 intersecting the connection bore 36 are provided in the steel connection block 35. The receiving bore 37 is aligned with the first section 19 of the channel K. A steel lining 38 is inserted into the first section 19 of the channel K, e.g. from the outer side. The steel lining 38 e.g. is a steel sleeve which extends into the receiving bore 37 and which is sealed against the first section inner wall by o-rings 39.

According to FIG. 8, further radial piston pump elements 33 also are mounted, all offset to each other in circumferential direction. Each radial piston pump element 33 is mounted at the mounting surface 18" with the help of a steel block 42. The blocks 42 are connected via pipings 41 or high pressure hoses with the steel connection block 35 such that all radial piston pump elements 33 discharge into the same channel K.

In a not shown embodiment of the pump aggregate A of FIGS. 7 and 8, several of the plurality of the radial piston pump elements 33 could discharge in the channel K while others jointly discharge into a channel which is drilled separately into the connection block 3.

Since the radial piston pump elements 33 are driven by an eccentric portion provided on the rotor shaft 23, a larger bearing is provided here for the rotor shaft 23 and, for this reason, the passage 17 shown in FIG. 1 is drilled with a larger diameter such that the passage intersects the second section 20 of the channel K. The second section 20 does not have any function in this embodiment.

FIG. 8 clarifies that in this embodiment, e.g. three radial piston pump elements 33 with a relative offset of 120° are mounted on the mounting surface 18". The radial piston pump elements 33, the steel connection blocks 35, the steel blocks 42 and the pipings 41, in some cases, may form a prefabricated sub-structure group.

For a type of a pump aggregate A which is longer than the one as shown in the preceding figures, in view of a larger oil volume and/or a larger mounting length of the wet-pit electric motor and/or of the pump elements instead of the shown caps 8, 9 one or two higher or longer caps may be mounted originating from a kit of caps of different heights. Furthermore, it is possible to prolong the construction length of the cast hollow body 1 by means of at least one prolongation ring R according to FIG. 9. The prolongation ring R in FIG. 9 has a cylindrical wall and an outer contour which substantially corresponds to the outer contour of the cast hollow body 1. Expediently, the prolongation ring R is also an aluminium chill cast part. Instead of the caps 8, 9 even substantially planar sheet metal plates or deep drawn sheet metal caps could be mounted to the prolongation rings.

FIG. 10 indicates a detail variant of the pump aggregate A (dual circuit system). In view of a high pressure range, analogously to FIG. 7, several radial piston pump elements 33 are mounted on the mounting surface 18" and are connected in joint fashion by the pipings 41 to the channel K which contains the steel lining 38 in the first section 19. Furthermore, a rotor shaft extension 44 drives a gear-wheel type pump element 22 which is mounted by means of an intermediate ring 43 on the radial piston pump elements 33 or on the lateral wall 16 of the bearing shield, respectively. A further bore 19 is drilled into the connection block 3 for the gear wheel type pump element 22 which further bore 19 is lined by a steel lining 38'. The further bore 19 communicates with the pressure exit of the gear wheel pump element 22. Furthermore, design variations are possible where either radial piston pump elements 33 or gear will type pump elements 23 are mounted at the lateral wall 16 of the bearing shield in several stacked planes (for several circuits or combined for a single circuit).

The invention claimed is:

1. Pump aggregate (A), comprising a one-piece cast hollow body (1) having a stator holding collar (15) formed into a lateral wall (16) of a bearing shield integrated into the inner wall, a wet-pit electric motor secured with its stator (24) in the holding collar (15), at least one pump element (33, 22) which is attached to the lateral wall (16) of the bearing shield, a pump element discharge side communicating via a pressure transmission path with a connection block (3) provided in the wall (12) of the cast hollow body (1), and cover lids (8, 9) for defining an oil reservoir in combination with the cast hollow body (1), the cover lids (8, 9) being attached at circular sealing surfaces (13) at the ends of the cast hollow body (1), characterized in that in the cast hollow body (1) has at least one pressure transmission path, at least one channel (K) is formed by casting in the lateral wall (16) of the bearing shield, and that the channel (K) extends from the connection block (3) into a mounting surface (18, 18', 18") of the lateral wall (16) of the bearing shield, which mounting surface (18, 18', 18") is machined for selectively securing either at least a radial piston pump element (33) and/or a gear wheel type pump element (22), said stator (24) carries a bearing shield (23) at the end remote from the lateral wall (16) of the bearing shield, that the bearing shield (25) is screwed to the holding collar (15), that the bearing shield (25) is secured by tensioning screws (26) of different lengths for different installation lengths of the wet-pit electric motor, and that the respective bearing shield (25) is of identical construction for different installation lengths of the wet-pit electric motor.

2. Pump aggregate, according to claim 1, characterized in that an inner side (14) of the wall (12) of the cast hollow body (1) is cast without undercuts up to both ends and to the sealing surfaces (13).

3. Pump aggregate, according to claim 1 characterized in that the channel (K) comprises a first section (19) extending at least substantially perpendicular to the longitudinal axis of the pump aggregate (1), and a second section (20) extending at least substantially parallel to the longitudinal axis, the second section (20) leading into the mounting surface (18, 18', 18").

4. Pump aggregate, according to claim 1, characterized in that a gear wheel type pump element (22) is attached on the mounting surface (18') such that the discharge side of the gear wheel type pump element (22) is directly connected with the second section (20) of the channel (K).

5. Pump aggregate, according to claim 1, characterized in that the wall (12) of the cast hollow body (1) is cylindrical.

6. Pump aggregate, according to claim 1, characterized in that the outer contour of the cast hollow body (1) is defined substantially by four arched sections, the radius of the curvature of which substantially corresponds to the inner diameter of the inner cross section of the cast hollow body (1), and that longitudinal ribs (2) are arranged between the wall and the outer contour of the cast hollow body (1).

7. Pump aggregate, according to claim 6, characterized in that—in a cross-section of the cast hollow body (1)—the longitudinal ribs (2) form four groups such that the longitudinal ribs are parallel to each other in each group and are offset to each other by about 90° from one group to the next.

8. Pump aggregate, according to claim 1, characterized in that each cover lid is a cast body having the shape of a cap (8, 9) with the inner side free of undercuts, the outer contour of which cap largely corresponds to the outer contour of the cast hollow body (1).

9. Pump aggregate, according to claim 8, characterized in that an oil filling in opening and/or an oil draining opening (5, 6) are provided in the respective cap (8, 9) adjacent to a cap edge and at the cap front side and at the cap side wall, which openings, preferably, are offset to each other about the longitudinal axis by about 180°.

10. Pump aggregate, according to claim 1, characterized in that the connection block (3) is cast within a thickened region (29) of the wall (12) of the cast hollow body (1) which region (29) is formed by casting and is formed at the inner side without undercuts.

11. Pump aggregate, according to claim 10, characterized in that a mount (10) is formed by casting into thickened region (29), the mount (10) having at least passage (11) for at least a power cable introducing element (21).

12. Pump aggregate, according to claim 1, characterized in that a return port (B) is formed by casting in the connection block (13).

13. Pump aggregate, according to claim 1, characterized in that a further channel (19') is drilled into the connection block (3) either up to the lateral wall (16) of the bearing shield or through the wall (12) in the thickened region (29) of the cast hollow body (1) only, the further channel (19') serving for a dual circuit system with several pump elements (32, 22) in the pump aggregate (A), and that, in some cases, the further channel (19') is equipped with a lining (38').

14. Pump aggregate, according to claim 1, characterized in that a fan wheel is arranged on a cap (8, 9) of the pump aggregate (A), which fan wheel is driven by the rotor shaft (23) which is extended through the cap or is driven by an external drive motor.

15. Pump aggregate, according to claim 1, characterized in that a least the cast hollow body (1) consists of aluminium chill cast produced in a casting mould free of inner radially moveable cores.

16. Pump aggregate (A), comprising a one-piece cast hollow body (1) having a stator holding collar (15) formed into a lateral wall (16) of a bearing shield integrated into the inner wall, a wet-pit electric motor secured with its stator (24) in the holding collar (15), at least one pump element (33, 22) which is attached to the lateral wall (16) of the bearing shield, a pump element discharge side communicating via a pressure transmission path with a connection block (3) provided in the wall (12) of the cast hollow body (1), and cover lids (8, 9) for defining an oil reservoir in combination with the cast hollow body (1), the cover lids (8, 9) being attached at circular sealing surfaces (13) at the ends of the cast hollow body (1), characterized in that in the cast hollow body (1) has at least one pressure transmission path, at least one channel (K) is formed by casting in the lateral wall (16) of the bearing shield, and that the channel (K) extends from the connection block (3) into a mounting surface (18, 18', 18") of the lateral wall (16) of the bearing shield, which mounting surface (18,18', 18") is machined for selectively securing either at least a radial piston pump element (33) and/or a gear wheel type pump element, said radial piston pump element (33) is mounted on said mounting surface (18") by use of a high pressure proof connection body (35) inserted into a bore drilled into said lateral wall (16) of said bearing shield, said bore intersecting the first section (19) of said channel (K); said connection body (35) comprises an inlet bore (36) communicating with said discharge side of said radial piston pump element (33) and comprises a receiving bore (37) aligned with said first section (19) of said channel (K) and that a hollow high pressure proof lining (38) is arranged within said first section (19) of said channel (k) and in said receiving bore (37), said lining (38) extending up to about the outer side of the connection block (3).

17. Pump aggregate, according to claim 16, characterized in that further radial piston pump elements (33), which are offset in circumferential direction to the one piston pump element (33) are mounted by use of connection bodies (42) on the mounting surface (18") and that the connection bodies (42) are interconnected via pressure pipings (41) with the connection body (35) of the one radial piston pump element (33) which directly communicates with to the channel (K).

18. Pump aggregate (A), comprising a one-piece cast hollow body (1) having a stator holding collar (15) formed into a lateral wall (16) of a bearing shield integrated into the inner wall, a wet-pit electric motor secured with its stator (24) in the holding collar (15), at least one pump element (33, 22) which is attached to the lateral wall (16) of the bearing shield, a pump element discharge side communicating via a pressure transmission path with a connection block (3) provided in the wall (12) of the cast hollow body (1), and cover lids (8, 9) for defining an oil reservoir in combination with the cast hollow body (1), the cover lids (8, 9) being attached at circular sealing surfaces (13) at the ends of the cast hollow body (1), characterized in that in the cast hollow body (1) has at least one pressure transmission path, at least one channel (K) is formed by casting in the lateral wall (16) of the bearing shield, and that the channel (K) extends from the connection block (3) into a mounting surface (18, 18', 18") of the lateral wall (16) of the bearing shield, which mounting surface (18, 18', 18") is machined for selectively securing either at least a radial piston pump element (33) and/or a gear wheel type pump element, a single base type of said hollow cast body (1) is used in several installation sizes of said pump aggregate (A) having different lengths, and that a respective one of caps having different lengths or one of prolongation rings (R) having different lengths is installed at said base type of said cast hollow body (1) or between the respective cap and the base type of said cast hollow body (1).

19. Pump aggregate, according to claim 18, characterized in that the prolongation ring (R) is a cast hollow body having a cross section which broadly corresponds to the cross section of the end of the cast hollow body (1), which prolongation ring is free of undercuts at the inner side.

* * * * *